United States Patent [19]

Toft, Jr.

[11] 4,337,530

[45] Jun. 29, 1982

[54] UNIVERSAL TIME-KEEPING SYSTEM AND APPARATUS

[76] Inventor: Leonard L. Toft, Jr., 599 Darwin, Apt. No. 3, Salt Lake City, Utah 84103

[21] Appl. No.: 153,433

[22] Filed: May 27, 1980

[51] Int. Cl.[3] ..... G04B 47/06; G04B 19/26; G04C 17/00

[52] U.S. Cl. ..... 368/62; 368/14; 368/16; 368/223; 368/239

[58] Field of Search ..... 368/16, 14, 15, 17–20, 368/232, 242, 239, 240, 241, 82–84, 220, 228, 62

[56] References Cited

U.S. PATENT DOCUMENTS

| | | | |
|---|---|---|---|
| 2,857,734 | 10/1958 | Weigenant | 368/14 |
| 3,772,874 | 11/1973 | Lefkowitz | 368/242 |
| 4,142,306 | 3/1979 | Whitlock | 368/16 X |

FOREIGN PATENT DOCUMENTS

| | | | |
|---|---|---|---|
| 990038 | 9/1951 | France | 368/232 |
| 1029794 | 6/1953 | France | 368/232 |

*Primary Examiner*—Vit W. Miska
*Attorney, Agent, or Firm*—Thorpe, North, Western & Gold

[57] ABSTRACT

A time-keeping method and device, especially useful as a novelty device for astrologers, that divides a day into twelve equal periods of time. Each period of time is further sub-divided into one-hundred equal sub-periods of time. Each sub-period of time may further be sub-divided into one-hundred equal intervals of time. The time-keeping method and device includes counter-clockwise motion of one revolution per day, which motion is synchronized to begin at a reference point on the face of the time-keeping device that corresponds to the conventional three o'clock position. The time-keeping method includes synchronizing this motion so that it begins at this reference point at a time corresponding to the mean time of the rising of the sun. The time display may be analog and/or digital. The points of the compass may also appear on the clock face, thereby allowing the counter-clockwise motion associated with the device to depict the position of the sun relative to the set of compass points.

13 Claims, 4 Drawing Figures

UNIVERSAL TIME-KEEPING SYSTEM AND APPARATUS

BACKGROUND OF THE INVENTION

This invention relates to a time-keeping apparatus and method, and more particularly to a time-keeping apparatus and method based on units of time other than conventional hours, minutes, and seconds. The apparatus itself is especially suited as a novelty device for those who enjoy approaching conventional tasks, in an unconventional manner. The invention is also especially well suited as a novelty device for astrologers.

Time-keeping devices and methods have undoubtedly existed since the beginning of man. Early systems primarily relied upon the apparent rotation of the sun relative to the earth as the basic time unit (that unit being a day, or "solar day"). Probably the earliest methods and devices used to divide the day into fixed increments of time included observing the relative position of the sun in the sky. This was done either directly, or by noting the direction of shadow cast by an object close to the sun. The sun dial, of course, became a refinement of this technique.

Other methods and devices for keeping time that were not dependant upon the sun were also developed. For example, the force of gravity was used to cause sand to fall through a narrow opening (the hourglass). Gravity was also used to cause a pendulum of a fixed length to swing back and forth at a fixed period.

As man and science progressed, and as the cyclic nature of the earth's rotations and season's were noted, the need for constant time standards became more and more apparent. While any phenomenon that repeats itself can be used as a measure of time, there has always existed a need to coordinate and standardize the measure of time. That is, a universal system for keeping time has been, and always will be, needed to enable an ordered society to function. A person needs to know the "time of day" so that his activities can be ordered and coordinated with the activities of others. The standard time units of "hours," and "minutes," and "seconds," along with the 24-hour day, have served for many years now as an effective method for keeping time.

The definition of an hour is 60 minutes. The definition of a minute is 60 seconds. The definition of a second is traditionally thought to be 1/86,400 of a mean solar day. This definition, however, is only approximate, and scientists long ago realized that a more precise definition of a "second" was needed. While the precise definition of a second for scientific purposes has also evolved (there being several definitions available), it appears that the more recent trend is to define a second in atomic terms as the duration of 9,192,631,770 periods of the radiation corresponding to the transition between the two hyperfying levels of the ground state of the Cesium-133 atom. See IEEE Standard Dictionary of Electrical & Electronics Terms, p. 617 (2d Ed. 1978).

Despite the universal and precise definition of a "second," the solar day remains the basic time unit around which most people order their lives. That is, most people are accustomed to rising, eating, working, and sleeping at certain times of the day depending upon the relative position of the sun. However, without direct reference to the sun, these times of the day are measured more conventionally in terms of hours, minutes, and seconds. It is interesting to note that legislation has even been enacted throughout most of the United States to "shift" references to the conventional time units (hours) forwards in order to allow more daylight hours during the evening hours of the summer (Daylight Savings Time). During the summer, of course, the number of daylight hours increases significantly over the number of daylight hours during the winter. Legislators, responding to the wishes of the majority of the people, have felt that it would be more advantageous to take advantage of these extra daylight hours during the evening, rather than the morning (when many people are sleeping). Thus, Daylight Savings Time legislation has been enacted throughout most of the United States.

One obvious effect of Daylight Savings, whether intended or not, is to begin the day for a majority of the people (those who sleep at night and work during the day) at approximately the same time relative to the mean rising time of the sun. That is, because of Daylight Savings Time, most people, on the average, begin their day, by rising at approximately the same mean time at which the sun rises.

The rising of the sun, however, is unfortunately not the time at which the day officially or legally begins. Rather, a day officially begins at 12:00 midnight, and most people don't rise until six or seven hours after this time. Moreover, 12:00 midnight is not a logical starting point for beginning a count of the hours that transpire during the day because one hour after 12:00 midnight the count jumps back to 1:00 o'clock.

Another problem with the present, or conventional method of keeping time, is that there are twenty-four hours a day and most clocks are designed only to display twelve hours. Thus, separate designations must be used, such as a.m. and p.m., to distinguish the morning hours from the afternoon hours. This problem has been effectively delt with by the Military, which uses a twenty-four hour time system. That is, in the Military the time 12:00 midnight (the beginning of the legal day) is approximately and logically referred to as 00:00 hours. Similarly, 6:00 a.m. is referred to as 06:00 hours, 12:00 noon is 12:00 hours, and 11:59 p.m. is referred to as 23:59 hours. Despite this more logical approach used by the Military, however, its system of measuring time remains virtually unused for the majority of civilian purposes.

SUMMARY OF THE INVENTION

A principal object of the present invention is to provide a time-keeping method that is logical, easy-to-use, and that begins keeping time each day at a point that is approximately coincident with the beginning of a person's daily activities.

A further object of the present invention is to provide such a time-keeping method that begins measuring time from the mean rising time of the sun.

Another object of the present invention is to provide a time-keeping apparatus that allows one to easily use and implement the time-keeping method described herein.

An additional object of the present invention is to provide such a time-keeping apparatus, in one embodiment thereof, that further indicates the relative position of the sun as the day progresses relative to a set of indicators or markers included as part of the apparatus.

Still a further object of the present invention is to provide a time-keeping apparatus that not only keeps accurate time but that also serves as a unique novelty device.

The above and other objects of the present invention are realized in a method of keeping time that includes dividing the day into twelve equal periods of time. Each period of time is thus equal to two conventional hours. Each of the twelve periods of time are further subdivided into 100 equal sub-periods of time. Each sub-period of time may appropriately be further subdivided into 100 smaller intervals of time.

Each of the twelve periods of time is given a unique numeric or other symbolic designation. Preferably, these designations will begin at a low number and sequentially increase. For example, if arabic numerals are used, the first period of time is referred to as 1, or 1 o'clock. The second period of time is referred to as 2 o'clock, the third 3 o'clock, and so on up through 12 o'clock. The first hour, or 1 o'clock is advantageously set so as to correspond the the mean time at which the sun rises (roughly 6:00 a.m. or 7:00 a.m. measured by conventional time methods).

The time-keeping method described herein is easily implemented using time-keeping apparatus of the type also described herein. One embodiment of a time-keeping apparatus includes a somewhat conventional clock face having twelve major divisions allocated in equiangular fashion around the perimeter thereof. Unlike a conventional clock face, however, the numbers or symbols assigned to each division increase in a counter-clockwise direction beginning with a "1" located in what would normally be thought of as the 3:00 o'clock position. One hundred minor divisions, also numbered to begin at the conventional 3:00 o'clock position, may also be allocated in equiangular fashion around the perimeter increasing in a counter-clockwise direction. The hands of the clock include a small hand and a large hand as would a conventional clock, although the hands would revolve in a counter-clockwise direction, the small hand making one complete revolution each day, and the large hand making twelve complete revolutions each day. A "second" hand may also be employed which likewise revolves in a counter-clockwise direction 100 times for each revolution of the large hand.

The clock face may further include the points of the compass marked thereon, with the north compass point pointing towards what is commonly thought of as the 12:00 o'clock position (although it is the 4:00 o'clock position using the method taught herein). Thus, the east compass point would point towards the conventional 3:00 o'clock position, the south compass point to the conventional 6:00 o'clock position, and the west compass point to the conventional 9:00 o'clock position. When properly set, the movement of the small hand (that makes one revolution each day) in addition to pointing to the desired "hour" also indicates the relative location of the sun with respect to the compass points, i.e., the sun rising in the east (morning hours), up in the north (mid-day hours), setting in the west (evening hours), and down in the south (mid-night hours).

An alternative embodiment of a time-keeping apparatus used to keep time according to the time-keeping method taught herein includes a digital clock. The digital clock includes a conventional oscillator as a time reference source. The output of the oscillator is divided or reduced in frequency to create three time reference signals, one of which is clocked 120,000 times each day, another of which is clocked 1200 times each day, and the last of which is clocked only 12 times each day. These clock signals are used to increment appropriate registers that have been properly set to begin counting from an appropriate reference point (such as the rising of the sun). Control and multiplexing circuitry is then used to display the contents of the registers in a suitable digital display. The digital display may also incorporate the points of the compass by placing an array of single element indicators therearound, with each indicator representing one of the compass points, and each indicator being energized through appropriate control circuitry once each day at a time and for a duration that is indicative of the sun's relative position with respect to the compass points.

BRIEF DESCRIPTION OF THE DRAWINGS

The above and other objects, features, and advantages of the invention will be more apparent from the following more particular description presented in connection with the accompanying drawings, in which.

DESCRIPTION OF THE PREFERRED EMBODIMENTS

Figure 1:
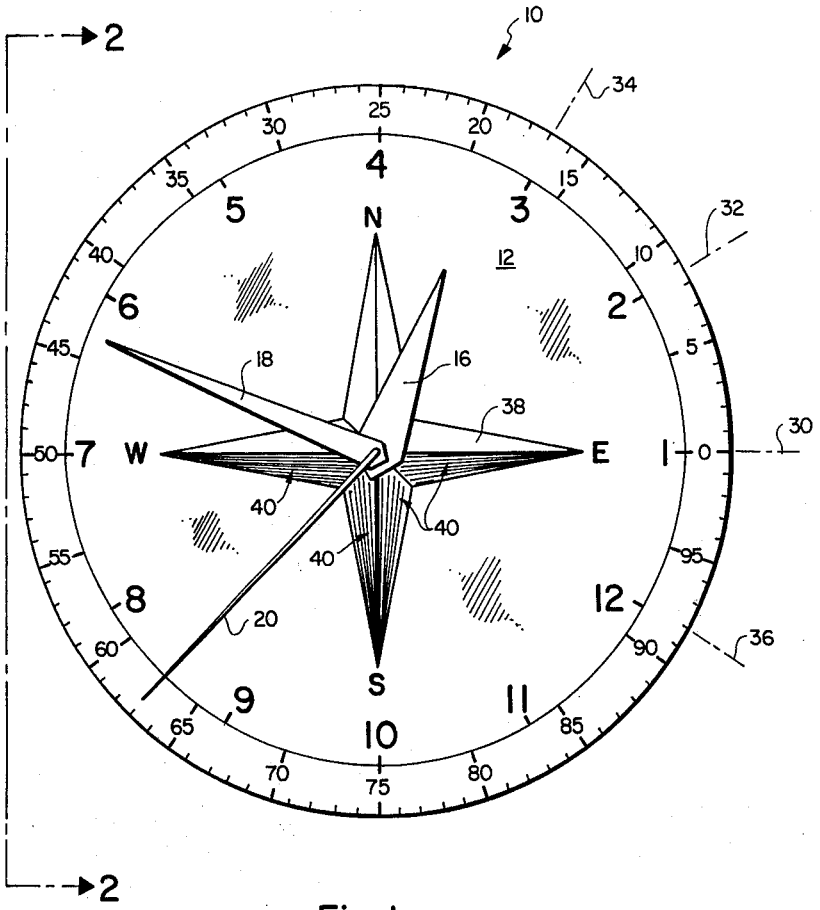
FIG. 1 is a front view of the face of a clock that has been designed to keep time according to the principles of the present invention.

At the outset, it will be helpful to define the units of time that will be used in connection with the discussion of the invention which follows. Therefore, for purposes of this application, the terms "hour," "minute," and "second" will be used in their conventional sense, with one second being equal to approximately 1/86,400 of a mean solar day, one minute being equal to 60 seconds, and one hour being equal to 60 minutes. The time units corresponding to the invention herein disclosed will also be referred to as hours, minutes, and seconds. However, in order to distinguish these special units from the conventional units, the letter "E" will be used as a prefix to each unit. Thus, the time units of the invention herein disclosed will be designated as "Ehour," "Eminutes," and "Eseconds." Appropriate abbreviations may also be used. Thus, one Ehour may be abbreviated as 1 "Ehr.", one Eminute may appear as 1 "Emin.", and one Esecond may appear as 1 "Esec."

The time-keeping method of the present invention contemplates dividing a day into twelve equal periods. These periods will be termed Ehrs. Thus, there are, with the time keeping system herein disclosed, 12 Ehrs. every day. Each Ehr. is subdivided into 100 Emin. And each Emin. is further subdivided into 100 Esec. Further divisions could be made if desired. Thus, it can be seen that 1 Ehr. is equivalent to 2.00 hours, 1 Emin. is equivalent to 1.20 minutes (or 72 seconds), and 1 Esec. is equal to 0.72 seconds.

The day is divided into twelve equal periods, or Ehrs., because it is the opinion of the inventor that the number 12 has special significance in a cosmic sense. Furthermore, the number 12 is fortunately already well ingrained into present time-keeping systems. The Ehrs. and Emins. are each divided into 100 sub-parts because 100 is an extremely easy number with which to work and calculate (as is evidenced by the entire metric system).

The time-keeping method of the invention contemplates more than merely dividing a day into twelve equal periods of Ehrs. An important part of the invention is to synchronize the time-keeping method so that the first Ehr. of the day occurs at a time that is approximately coincident with the rising of the sun. For example, 7:00 a.m., which time may be close to the mean time of sun-rise, would be converted to 1:00 Etime. (For purposes of this application the term "Etime" will also be used to refer to time designations under the universal time-keeping system that is the subject of the present invention.) Thus if 1:00 Etime is the same as 7:00 a.m. in conventional time, then it is readily seen that with each Ehr. equal to two hours of conventional time that 3:50 Etime would be equivalent to 12:00 noon in conventional time, 7:00 Etime would be equivalent to 7:00 p.m. in conventional time, and 10:00 Etime would be equivalent to 1:00 a.m. in conventional time.

The time-keeping method herein described advantageously begins counting time coincident with the time at which most people begin their daily activities. This is not only a logical way to keep track of time, but it can have a tremendous psychological effect on a person to know that as he begins his day by rising in the morning that time also begins to be measured at the approximate same point. Thus, a person faces each day with a fresh start beginning at 1:00 Etime. By 2:00 Etime the average person will have already arrived at work, and by 6:00 or 7:00 Etime the work day will be over after only four or five Ehrs. The person still has half of the day remaining during which he can pursue leisure activities and sleep.

Figure 2:
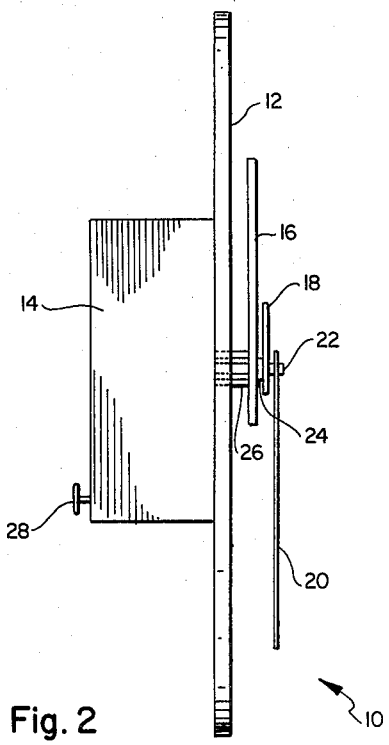
FIG. 2 is a side view of the clock of FIG. 1.

An apparatus or Etime clock that could be used to keep time according to the principles of the present invention is illustrated in FIGS. 1 & 2. FIG. 1 shows a front view of an Etime clock 10 and FIG. 2 illustrates a side view of the same item. The clock 10 comprises generally a clock face 12, a time reference source 14, a small hand 16, and a large hand 18. The small hand 16, or Ehr. hand, is similar to the conventional hour hand of a conventional clock. Similarly, the large hand 18, or Emin. hand, is similar to the minute hand of a conventional clock. An additional hand 20 may also be used to indicate Esecs. Thus, the hand 20, or Esec. hand, is equivalent to the second hand of a conventional clock.

The time reference source 14 includes a conventional clock movement that may be powered by springs, batteries, or household electric current. It includes a network of gears, shafts, and other moveable items that are coupled to concentric output shafts. A first shaft 22 protrudes transversely out from the clock face 12 and is securely fastened to one end of the hand 20. The time reference source 14 causes the shaft 22 to make 1200 complete revolutions every solar day.

Another shaft 24, concentric with the shaft 22, also transversely protrudes from the clock face 12 and is attached to the Emin. hand 18. This shaft 24 is caused to rotate by the time reference means 14 twelve revolutions every solar day. A third shaft 26, concentric with the shafts 22 and 24, likewise protrudes from the clock face 12 and is attached to the Ehr. hand 60. This shaft 26 makes on complete revolution every day.

As with any conventional clock, the movement of the hands 16, 18, and 20 is interrelated through the time reference source 14. That is, the Ehr. hand 16 will rotate 30°, or 1/12 of a complete revolution, for each complete revolution of the Emin. hand 18. Similarly, the Emin. hand 18 will rotate 3.6°, or 1/100 of a complete revolution, for each complete revolution of the Esec. hand 20. Means are provided, such as through an external knob 28 protruding from the back of the reference source 14, to set, or synchronize, the hands at a desired time.

A significant difference between the Etime clock 10 and a conventional clock, is that each of the hands 16, 18, and 20, rotate in a counter-clockwise direction when viewed from the front of the clock face 12. Another significant difference between the Etime clock 10 and conventional clocks is the markings which appear on the face thereof. While twelve equiangular divisions appear around the perimeter of the clock face 12, as would exist with a conventional 12 hour clock, the divisions are numbered differently. For example, at what would normally be considered as the 3:00 o'clock position, shown generally as the dotted line 30 in FIG. 1, a number 1 is used to designate the 1:00 Etime position. Proceeding from this 1:00 Etime position in a counter-clockwise direction around the circumference of the clock, other designators are used to indicate the sequentially increasing Ehrs. Thus, a 2 appears at what would normally be considered the 2:00 o'clock position at the dotted line 32, a 3 appears at what would normally be considered the 1:00 o'clock position at the dotted line 34, and so on around the entire circumference of the clock. The 12:00 Etime position is thus equivalent to what would normally be considered the 4:00 o'clock position at the dotted line 36. While arabic numerals are shown in FIG. 1, it is to be understood that any numbering system could be used to mark the Ehrs. around the clock face 12 in a counterclockwise direction. For example, roman numerals, dots, or any other numbering system could be used. The important point is that the beginning Ehr. is generally in the area indicated by the dotted line 30.

The perimeter of the clock face 12 may further be subdivided to indicate the Emins. and the Esecs. This is done by placing 100 equiangular spaced divisions (or another desired number of equiangular divisions, said desired number being a fractional or intregal multiple of 100) around the circumference or perimeter in an appropriate fashion. These divisions are marked, to begin at the dotted line 30 with the markings increasing in value a counter-clockwise direction. In FIG. 1, every fifth division is marked with an appropriate numerical indicator, although it is to be understood, that any appropriate numbering sequence and symbols could be used to achieve this purpose.

With the hands 16, 18, and 20 in the positions shown in FIG. 1, it is seen that the Etime indicated is 3:43:63, meaning that 3 Ehrs., 43 Emins., and 63 Esecs. have elapsed since the beginning reference point of 1:00:00 Etime. Assuming 7:00 a.m. (conventional time) is this beginning reference point, this Etime of 3:43:63 is almost 12:00 noon in conventional time (noon being equal to 3:50 Etime). As mentioned previously, this beginning reference point of 1:00:00 Etime will advantageously correspond to a time when an average person begins his daily activities, such as when the sun rises. For example, the 1:00:00 Etime reference point could correspond to the conventional time of 7:00 a.m.

An important feature that can be employed with one embodiment of the invention is also illustrated in FIG. 1. That feature includes placing a set of compass points, including east, north, west, and south on the face 12 of the Etime clock 10. The east compass point faces or points to the 1:00 o'clock Ehr., the north compass point to the 4:00 o'clock Ehr., the west compass point to the 7:00 o'clock Ehr., and the south compass point to the 10:00 o'clock Ehr. The east, north, west and south compass points are designated with an E, N, W, and S respectively in FIG. 1.

The purpose of including the compass points on the clock 12 is to give a visual indication of the relative location of the sun as the day progresses. This relative position will be indicated by the direction in which the Ehr. hand 16 is pointing. That is, at the beginning of the day when the Ehr. hand 16 is pointing towards the 1:00 o'clock Ehr., this hand will also be pointing to the east compass point E. East, of course, is the direction from which the sun rises. As the day progresses, the sun appears to rise in the sky until it is directly overhead at mid-day. At this time, the hand 16 will point straight up to the north compass point N. As the day progresses thereafter, the sun will lower and approach the western sky. As the sun sets, the hand 16 will point to the west compass point W. During the evening and nighttime hours, when the sun is not up, the Ehr. hand 16 correspondently points in a downward direction, pointing to the south compass point S at 1:00 a.m. A compass star 38, or other compass design may be included with the compass points N, E, W, and S, so as to emphasize the role of the compass points. This star 38 (or other design) may advantageously be shaded as shown generally at 40 on the bottom half thereof to emphasize that when the Ehr. hand 16 is in the shaded region, the sun is set. Of course, the sun will not always rise precisely at 1:00:00 Etime and will not always set at 7:00:00 Etime, but these will only approximate the actual rising and setting of the sun. Daylight Savings Time can also be implemented with the device by merely resetting the time reference forwards (in Spring) and backwards (in Fall), although it is hoped that universal adoption of the time keeping method herein disclosed will preclude the necessity of "Daylight" Savings Time. For the astrologer, and other persons who make special note of the sun's position, the addition of the compass points to the Etime clock 10 give it a special dimension which has heretofore been unachieved in time-keeping devices.

Figure 3:
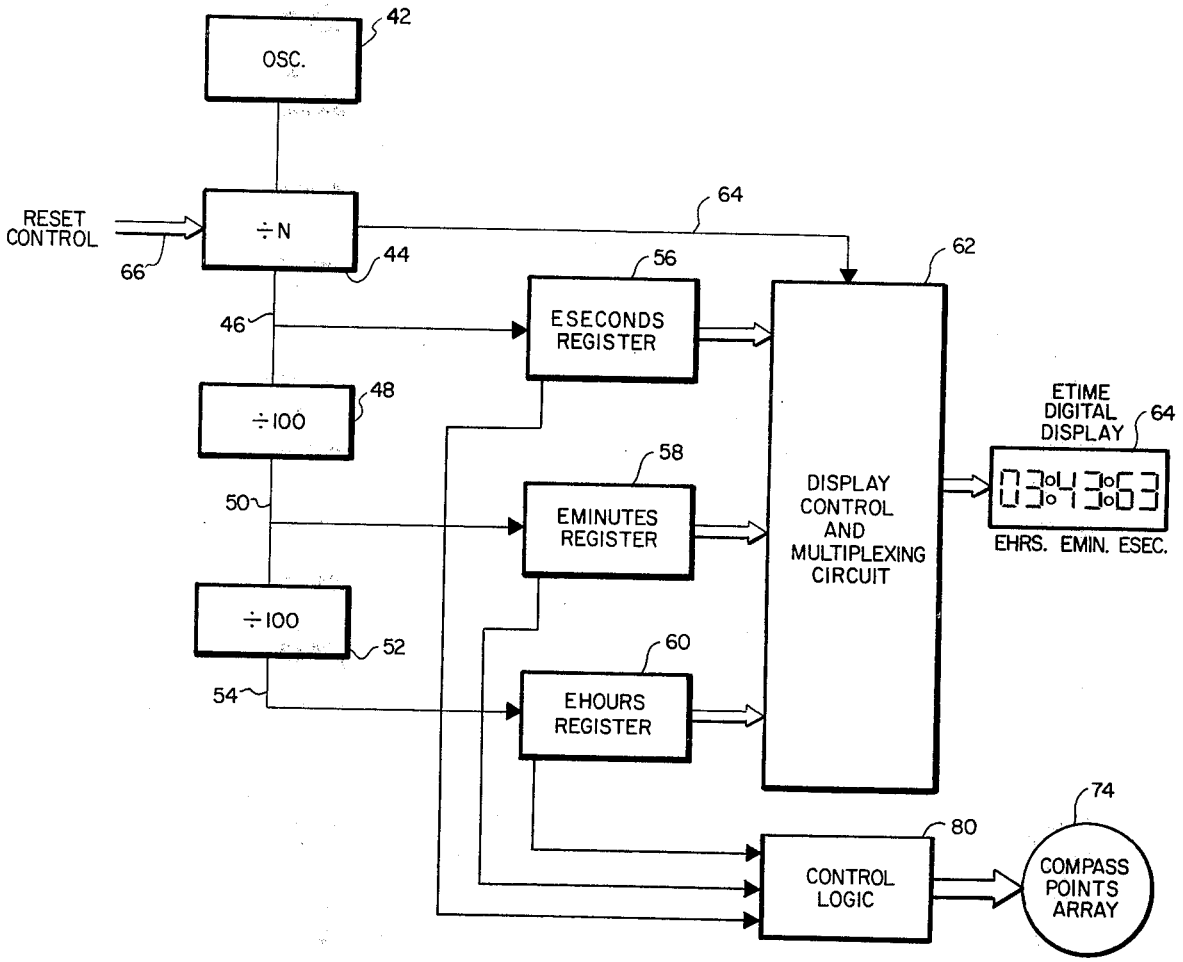
FIG. 3 is a block diagram of a digital clock that is designed to keep time according to the time-keeping method of the invention.

It is also possible to realize a digital Etime clock. A block diagram of an Etime digital clock is illustrated in FIG. 3. An oscillator 42 is used as the time reference source. It generates a signal having a fixed frequency. A series of dividing circuits are then used to reduce the frequency of the oscillator 42 to a desired level. For example, a dividing circuit 44 may advantageously derive a reference signal appearing on signal lines 46 that has a period pulse rate of 120,000 pulses every day. This reference signal may then be divided by a divide by 100 circuit 48 to produce a second reference signal line 50 that has 1200 periodic pulses every solar day. in turn, this second reference signal may be further divided by a divide by 100 circuit 52 so as to produce a third reference signal line 54 that contains 12 period pulses every day. The dividing circuits 44, 48, and 52 may be realized using ripple counter design techniques, synchronous counter design techniques, or other techniques known in the art.

Signal line 46 is directed to an Esecs. register 56. The function of this register 56 is to accumulate and store the number of pulses or clocking edges that occur on the first time reference signal. Similarly, an Emins. register 58 accumulates and stores the number of pulses or clocking edges occuring on the second reference signal appearing on signal line 50. Likewise, an Ehrs. register 60 accumulates the pulses or clocking edges occuring in the third reference signal occuring on signal line 54. The outputs of the registers 56, 58, and 60 are directed over appropriate signal buses to a display control and multiplexing circuit 62. This circuit, which may receive timing signals over signal line 64 from the dividing circuit 44, stears a digital display 64 that indicates the appropriate Etime in Ehrs., Emins., and Esecs. The appropriate time may be easily set on the digital display 64 via a reset control 66 that interfaces with the dividing circuit 44. This control 66 could advantageously change the dividing factor of the circuit, thereby significantly increasing the pulse or clock rates that appear on the first, second, and third reference signals, thereby allowing the digital display to quickly count up to a desired time.

All of the blocks shown in FIG. 3 may be easily realized by those skilled in the art using commercially available integrated circuits and/or other components. If integrated circuits are used, they may be either TTL or CMOS, or any other types that are or become available. The only critical design criteria would be selecting an appropriate oscillator 42 and divide-by-N circuit 44 so as to produce the appropriate pulsed reference signals on signal lines 46, 50, and 54.

One embodiment of the Etime digital display could also incorporate an array of compass points as was used in connection with the Etime clock 10 of FIG. 1. This embodiment could be realized as illustrated in the perspective view of FIG. 4, which illustrates an Etime digital clock 70 that includes a digital display 64 mounted in a cabinet 72 and which further includes an array of indicators 74 that are equiangularly spaced around the display 64 so as to correspond with the compass points. Each element of the array 74 may be a single element display, such as a light-emitting diode (LED). The indicators can be controlled so that each indicator is energized once each day at a time and for a duration corresponding to the sun's relative position in a manner similar to that described in connection with FIG. 1. Thus, for example, at the Etime reference beginning point of 01:00:00 Ehrs., the indicator 76 corresponding to the east compass point would be energized. At an appropriate time later, the indicator 76 would be de-energized and adjacent indicator 78 (corresponding to the east-northeast compass point), would be energized. Alternatively, appropriate control circuitry could be used so that the indicator 78 fades off as the indicator 78 fades on, thus making it possible to have both indicator 76 and 78 on simultaneously when the relative position of the sun would be midway between the two points. The indicators in the array 74 would thus be sequentially energized in a counter-clockwise direction around the digital display 64. If desired, indicators on the bottom half of the array, could be selectively chosen to be a darker color than the indicators along the top half of the array, thereby serving to emphasize the daylight hours, when the sun is up, from the evening and nighttime hours, when the sun is down.

Figure 4:
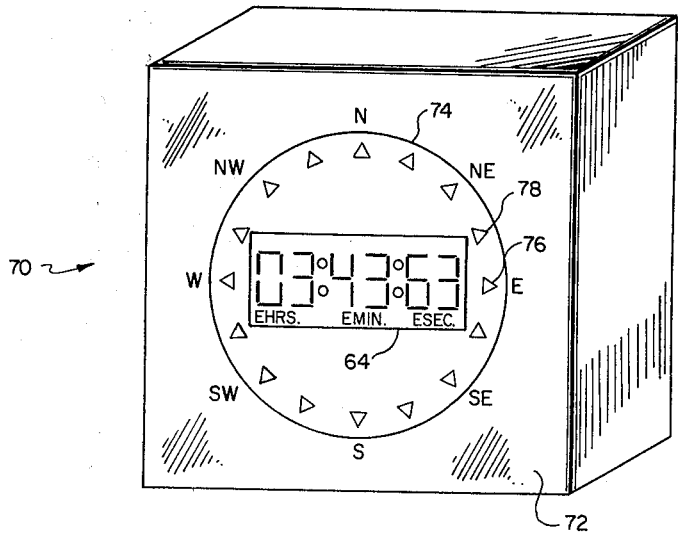
FIG. 4 is a perspective view of a digital clock built according to the present invention that further includes compass point indicators.

A method of energizing the compass array 74 shown in FIG. 4 is illustrated in FIG. 3 by the phantom lines illustrating a control logic block 80 which interfaces with the compass point array 74. The control logic 80 would monitor the status of the registers 56, 58, and 60, and depending upon the status of each register, select the appropriate element of the array 74 which was to be energized. The control logic 80 could be easily realized by those skilled in the art using conventional logic circuits and other components. The only design consideration would be to appropriately allocate the energizing of each element so that each is sequentially energized an equal amount of time. With the embodiment shown in FIG. 4, where 16 compass points are used and each has its own indicator, each could illustratively be energized for 75 Emin. If the fade-on, fade-off overlap technique is used as described above, then each of the 16 indicators may appropriately be on longer than 75 Emin.

While the invention herein disclosed has been described by means of specific embodiments and applications thereof, numerous modifications and variations could be made thereto by those skilled in the art without departing from the spirit and scope of the present invention. It is therefore to be understood that within the scope of the appended claims, the invention may be practiced otherwise than as specifically described herein.

What is claimed is:

1. A time-keeping method comprising the steps of:

(a) dividing a day into twelve equal periods of time, each period of time being designated with successively increasing numbers starting with one and increasing to twelve;

(b) dividing each of said twelve equal periods of time into one-hundred equal sub-periods of time;

(c) dividing each of said sub-periods of time into one-hundred equal increments of time;

(d) using said increments of time as the basic time interval around which a timing device is designed, said timing device being adapted to display the passage of time as a counter-clockwise motion around a face of said timing device, said counter-clockwise motion depicting one counterclockwise revolution around said face once each day, said face being adapted to indicate the passage of time in units comprised of said periods of time, sub-periods of time, and increments of time; and (e) synchronizing said timing device so that said counter-clockwise motion begins from a beginning reference point on said face that corresponds to the three o'clock position of a conventional clock face at a time that is coincident with the mean time of the rising of the sun.

2. A time-keeping method as defined in claim 1 wherein said timing device, in addition to displaying the passage of time, further includes a set of compass points including east, north, west and south, around its face, whereby said counter-clockwise motion symbolically displays the approximate relative position of the sun with respect to the location of the time-keeping device, the relative position of the sun being depicted by said general counter-clockwise motion with respect to said set of compass points so that the sun's position is placed in the east in the morning, moves it northwardly as mid-day approaches, puts it in the west during the evening, and moves it southerly as mid-night approaches.

3. A time-keeping apparatus comprising:

a fixed-frequency time reference source; having an output;

a time display, including a clock face, for displaying time derived from said fixed-frequency time reference source, said time display including a display of motion in a counter-clockwise direction about said face once each day; and control means coupled to said output of said time reference source for controlling said time display so that time displayed thereon is divided into twelve equal large time units each day, each of said large time units being designated with successively increasing numbers that increase in a counter-clockwise direction, said numbers being equiangularly spaced around said face so as to define twelve main divisions, each of said large time units being further sub-divided into one-hundred equal sub-time units, said control means further including means for beginning the counter-clockwise motion at a beginning reference point on said face that corresponds to the three o'clock position of a conventional clock face, said motion beginning at said reference point at a time that corresponds to a first of said large time units.

4. A time-keeping apparatus as defined in claim 3 wherein said time display includes:

a first hand substantially parallel to said clock face; and a second hand substantially parallel to said clock face;

said hands each being mounted towards one end thereof to respective concentric rotatable shafts protruding transversely from the center of said clock face, said shafts being coupled to and driven by said control means;

said first hand being controlled through said control means so as to make one complete revolution at a constant angular speed each day; and said second hand being controlled through said control means to make twelve complete revolutions at a constant angular speed each day.

5. A time-keeping apparatus as defined in claim 4 wherein said clock face further includes one-hundred sub-divisions equiangularly spaced around the perimeter of said clock face, each of said sub-divisions corresponding to a number symbol, said number symbols increasing in value in a counter-clockwise direction, the lowest of said number symbols being positioned at said beginning reference point.

6. A time-keeping apparatus as defined in claim 5 wherein said clock face further includes a set of compass points including east, north, west, and south marked thereon, with the east compass point pointing towards the main division corresponding to the first main division at the conventional three o'clock position, the north compass point pointing towards the fourth main division at the twelve o'clock position of a conventional clock face, the west compass point pointing towards the seventh main division at the nine o'clock position of a conventional clock face, and the south compass point pointing towards the tenth main division at the six o'clock position of a conventional clock face.

7. A time-keeping apparatus as defined in claim 4 further including a third hand substantially parallel to said clock face and mounted towards one end thereof to a protruding rotatable shaft that is concentric with said shafts of said first and second hands, said shaft of said third hand being coupled to and driven by said control means so as to cause said third hand to revolve around said clock face one-hundred times for each complete revolution of said second hand.

8. A time-keeping apparatus as defined in claim 3 wherein said time display comprises a digital display.

9. A time-keeping apparatus as defined in claim 8 wherein:

said time reference source comprises an oscillator that generates a periodic output signal having a fixed frequency; and said control means comprises:

dividing circuits for dividing said fixed frequency output signal to first, second, and third pulsed signals, said third pulsed signal having one pulse for every one-hundred pulses of said second pulsed signal, said second pulsed signal having one pulse for every one-hundred pulses of said first pulsed signal, and said first pulsed signal having equitimed pulses derived from said fixed frequency output signal that recur every 720 milliseconds, accumulation registers responsive to said first, second and third pulsed signals for counting and storing the number of pulses that occur in each pulsed signal, display control circuitry for monitoring the count contained in each of said accumulation registers and for causing said digital display to display said count, and reset means for reseting the count of said accumulation registers to a desired count.

10. A time-keeping apparatus as defined in claim 9 wherein said counter-clockwise motion display includes an array of indicators arranged equiangularly around said clock face, said indicators each coupled to said control means so that each is energized once each day for an equal length of time, and further wherein said indicators are sequentially energized in a counter-clockwise direction around said display.

11. A time-keeping apparatus as defined in claim 10 wherein said array of indicators are comprised of light-emitting diodes.

12. A time-keeping apparatus as defined in claim 10 further including a set of compass points including east, north, west, and south marked around said clock face.

13. A time-keeping device as defined in claim 12 wherein the indicator closest to the east compass point is energized when said digital display is displaying its lowest number.

* * * * *